United States Patent [19]

Stutes

[11] Patent Number: 4,665,568

[45] Date of Patent: May 19, 1987

[54] NIGHTTIME SAFETY HEADGEAR AND NOVELTY DEVICE

[76] Inventor: Rolin K. Stutes, P.O. Box 3121, Carson City, Nev. 89702

[21] Appl. No.: 631,463

[22] Filed: Mar. 21, 1985

[51] Int. Cl.[4] ..... A42B 1/06

[52] U.S. Cl. ..... 2/209.2; 2/199; 362/106; 362/105

[58] Field of Search ..... 2/209.2, 186, 199; 362/105, 106; 446/27

[56] References Cited

U.S. PATENT DOCUMENTS

| | | | |
|---|---|---|---|
| 3,254,444 | 6/1966 | Paterson | 2/199 X |
| 3,665,451 | 5/1972 | Keith | 362/105 X |
| 3,676,664 | 7/1972 | Corvetti | 362/106 |
| 3,947,676 | 3/1976 | Battilana et al. | 362/105 |
| 4,231,079 | 10/1980 | Heminover | 362/106 |
| 4,298,913 | 11/1981 | Lozar | 362/105 X |
| 4,447,250 | 5/1984 | Wolens et al. | 2/199 X |

*Primary Examiner*—Philip R. Coe
*Assistant Examiner*—J. L. Olds

[57] ABSTRACT

Safety nighttime headgear consisting of a soft cap with a visor and a molded plastic unit which supports two antenna like protrusions, each including three light emitting diodes, incorporated into the soft cap. A single safety light is centered in the molded plastic unit in the front of the cap. The light emitting diodes are powered by an electrical system molded directly into the molded plastic unit and powered by a three volt lithium battery. The electrical system is activated by an on/off switch via a button located a the top of the cap.

1 Claim, 2 Drawing Figures

NIGHTTIME SAFETY HEADGEAR AND NOVELTY DEVICE

BACKGROUND OF INVENTION

1. Field of the Invention

This invention is a safety device intended mainly for the use of children which incorporates the use of a lighting system into a cloth stylized cap.

2. Prior Art

In the past, such safety devices have been designed to require that they be added to an already existing hard headgear, or have been merely a support structure worn on the head which required fitting and adjustment by the wearer. The present invention is a completely self-enclosed system for safety lighting that requires no manipulation or adjustment by the wearer and is based on a stylized soft cap.

SUMMARY

The present headgear invention is intended to act as an easily wearable, and therefore attractive device for use with children. The safety cap consists of a stylized cloth cap with visor which incorporates a form fitting molded plastic unit as a support and electrical mount. The safety device is of unitary construction and requires no manipulation or adjustment by the wearer. The invention includes the outer cap and visor, a molded plastic unit which incorporates the electrical system, two antenna like protrusions with three light emitting diodes in each, and one safety headlamp centered in the front of the cap.

The primary purpose of the invention is to provide an attractive and easy to use safety device requiring no adjustments by the wearer which will prove especially beneficial for use with children.

DESCRIPTION OF THE PREFERRED EMBODIMENTS

Figure 1:
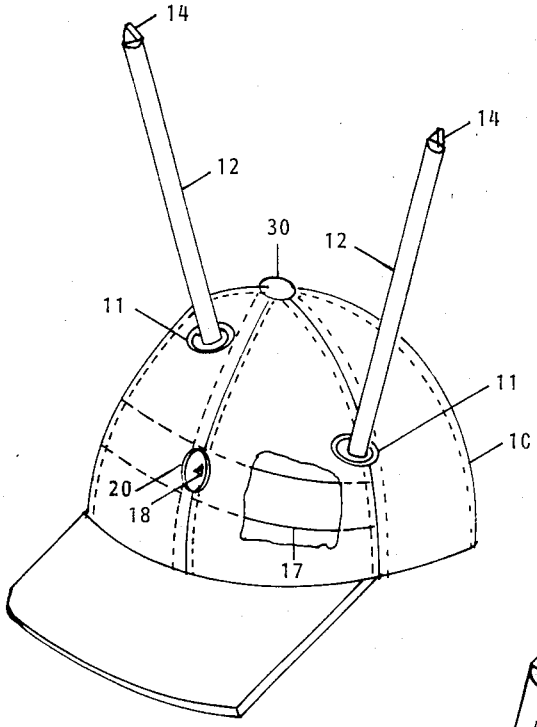
FIG. 1 is an external view of the cloth cap, safety light, button on cap, and antennae rising from the front quadrants and includes a cut-away view of the inner molded plastic unit.

FIG. 1 depicts an outer view of the invention with a cut-away of the molded plastic unit 17. The cap is generally shown as 10 and includes two antenna like projections 12 situated in the forward two quadrants of the cap. The antennae are approximately 5½" in length and are placed approximately 3½" apart. They are placed to simulate the placement of honeybee antennae. The male ends 16 of the antenna 12 enter the cap 10 through eyelets 11 which will support and secure the antennae. Further, there is a single white miniature safety lamp 18 extending through the front of the cap and held in place by a chrome plastic ring 20. The lighting apparatus is activated by depressing the button 30 attached to the cap. Button 30 in turn makes contact with a push on/off switch 22 contained within the molded plastic unit 17 directly below. Button 30 is free floating and unattached to on/off switch 22. The antenna 12 and the single safety lamp 18 are supported and held in place by the molded plastic unit 17 incorporated into the cap and shown in the cut away view.

Figure 2:
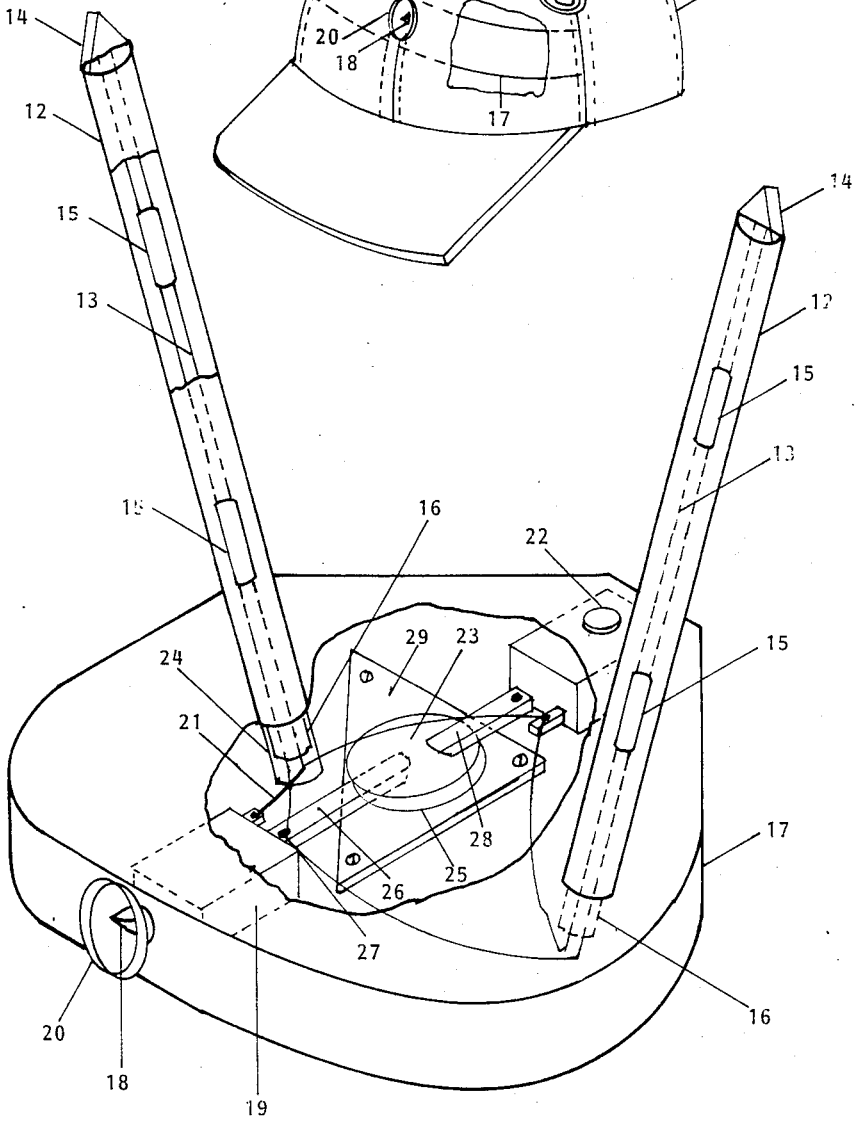
FIG. 2 is an internal view of the molded plastic unit along with its component parts and the electrical system from the battery, on/off switch, to the antennae and front safety light.

FIG. 2 shows the specifics of the electrical system as contained by the molded plastic unit 17. The electrical system is powered by a dry lithium cell (3 v, button) 23 which sits in a battery indentation 25 molded into the molded plastic unit 17. The battery is held in place by a flat piece of metal 26 which also acts as the positive connection to the battery. The metal piece is secured by a screw 27 which also secures the wires from the antennae. The negative connection completing the circuitry is provided by a float metal piece 28 which is part of the on/off switch 22. Also shown is the miniature lamp housing 19 which holds the front safety lamp 18. The battery ensemble is protected by a triangular battery dust cover 29.

The two antenna 12 are secured into the molded plastic unit 17 through the fitting of the male antennae connectors 16 and the female antennae receptacles 24. In each of the antenna 12, there is found a triangular light emitting diode 14 at the far end with two more mini type light emitting diodes 15 spaced down the antenna 12. The two triangular light emitting diodes 14 and the four mini type light emitting diodes 15 are connected with the electrical system via the antenna wiring 13 which, from the left hand antenna leads to the positive connection 26 by the positive connection screw 27 and to the molded plastic unit circuitry 21. The right hand antenna 12 has its antenna wire 13 connecting to both the positive screw connection 27 and the on/off switch 22.

The foregoing is considered as illustrative only of the principles of the invention. Since numerous modifications and changes will readily occur to those skilled in the art, it is not desired to limit the invention to the exact construction and operation shown and described, and accordingly all suitable modifications and equivalents may be resorted to, falling within the scope of the invention.

I claim as my invention:

1. A hat assembly comprising, in combination: a stylized soft cloth cap with a visor; a molded plastic unit attached to said soft cap; encapsulated light activating circuitry within said molded plastic unit; two antenna like appendages attached to said molded plastic unit and extending through said soft cap for viewing; each antenna like appendages containing three light emitting diodes spaced equidistant along and within each antenna like appendage; a single white light safety device centered in a front portion of said soft cap and secured to said molded plastic unit; an electric power source, requiring no remote power source or external wiring, contained within the circuitry of said molded plastic unit for powering said light emitting diodes and white light safety device wherein all operating circuitry and an on/off switch is contained within said molded plastic unit.

* * * * *